US007590362B2

(12) United States Patent
Yamauchi et al.

(10) Patent No.: US 7,590,362 B2
(45) Date of Patent: Sep. 15, 2009

(54) IMAGE FORMING APPARATUS FOR COMMUNICATING WITH SHEET PROCESSING APPARATUS FOR EXECUTING POST-PROCESS TO SHEET

(75) Inventors: Manabu Yamauchi, Tokyo (JP); Naoto Watanabe, Abiko (JP); Takayuki Fujii, Toshima-ku (JP); Shunsuke Nishimura, Toride (JP); Mitsuhiko Sato, Kashiwa (JP); Hidenori Sunada, Toride (JP); Ichiro Sasaki, Toride (JP); Akinobu Nishikata, Kashiwa (JP)

(73) Assignee: Canon Kabushiki Kaisha (JP)

( * ) Notice: Subject to any disclaimer, the term of this patent is extended or adjusted under 35 U.S.C. 154(b) by 569 days.

(21) Appl. No.: 11/470,948

(22) Filed: Sep. 7, 2006

(65) Prior Publication Data

US 2007/0166055 A1 Jul. 19, 2007

(30) Foreign Application Priority Data

Sep. 8, 2005 (JP) ..... 2005-261120
Aug. 24, 2006 (JP) ..... 2006-227703

(51) Int. Cl.
*G03G 15/00* (2006.01)

(52) U.S. Cl. ..... 399/18; 399/407

(58) Field of Classification Search ..... 399/9, 399/18, 19, 37, 88, 407–410; 358/1.14, 1.15, 358/296, 300; 714/22, 24, 48
See application file for complete search history.

(56) References Cited

U.S. PATENT DOCUMENTS 4,627,711 A * 12/1986 Schron ..... 399/20
5,126,786 A * 6/1992 Tanaka ..... 355/46
6,028,675 A * 2/2000 Fields et al. ..... 358/1.14
6,614,545 B1 * 9/2003 Langer et al. ..... 358/1.15
6,674,976 B2 * 1/2004 Sato et al. ..... 399/18
7,088,017 B2 8/2006 Motegi
2005/0286923 A1 * 12/2005 Kim ..... 399/75

FOREIGN PATENT DOCUMENTS

JP 1287680 A 11/1989
JP 08202207 A * 8/1996
JP 9-301618 A 11/1997
JP 2003107967 A 4/2003

* cited by examiner

*Primary Examiner*—Robert Beatty
(74) *Attorney, Agent, or Firm*—Rossi, Kimms & McDowell LLP

(57) ABSTRACT

In an image forming system having an image forming apparatus which forms an image onto a sheet and a sheet processing apparatus which is connected to the image forming apparatus and executes a post-process to the sheet, an abnormality in communication between the image forming apparatus and the sheet processing apparatus is detected, and when the communication abnormality is detected, an avoiding process for the abnormality is executed. A preprocess for a power shutdown is executed in accordance with an operation of a power switch to shut down a power source of the image forming system and, even if the communication abnormality is detected during the preprocessing step, the communication abnormality is ignored and the avoiding process is not executed.

5 Claims, 14 Drawing Sheets

508

| STATUS | OK | NG | OK | OK |
|---|---|---|---|---|
| JOB INFORMATION | FINISHER | STACKER | SHEET FEEDING APPARATUS A | SHEET FEEDING APPARATUS B |
| a | ○ | – | ○ | – |
| b | – | ○ | ○ | – |
| c | ○ | ○ | – | ○ |
| d | ○ | – | – | ○ |

610 CANCEL

IMAGE FORMING APPARATUS FOR COMMUNICATING WITH SHEET PROCESSING APPARATUS FOR EXECUTING POST-PROCESS TO SHEET

BACKGROUND OF THE INVENTION

1. Field of the Invention

The invention relates to an image forming apparatus for detecting an abnormality of a sheet processing apparatus.

2. Description of the Related Art

Hitherto, an image forming system in which a plurality of post-processing apparatuses are connected to an image forming apparatus in tandem and predetermined post-processes are executed has been known. In such an image forming system, in order to avoid such a situation that the whole system cannot be used if an error occurred in one post-processing apparatus, a selecting portion to select use/non-use of the post-processing apparatus is provided. The non-use of the error-occurred post-processing apparatus is clearly selected in the selecting portion, thereby making control so that a part of the whole system can be used without disabling the whole system to be used (Japanese Patent Application Laid-open No. H09-301618.

However, the above conventional image forming system has the following problems. After the error occurred, by disconnecting the error-occurred apparatus from the image forming system, it is possible to avoid such a situation that the whole system cannot be used. However, when the error has occurred, since the whole image forming system is temporarily halted, for example, even in the case where an inputted job is not concerned with the error-occurred apparatus, such a job cannot be continued.

If an abnormality is detected in communication with a sheet processing apparatus for a period of time during which a power source of the image forming system is actually turned off after the operation to turn off the power source was executed, there is a case where in spite of the fact that a flow for turning off the power source has been predetermined, an error process is executed and an operability deteriorates.

SUMMARY OF THE INVENTION

It is an object of the invention to provide an image forming apparatus which can solve the foregoing problem.

Another object of the invention is to provide an image forming apparatus in which when an error has occurred in a sheet processing apparatus which is not concerned with a job, the job can be continued without halting a whole image forming system, and usability of the user can be improved.

Other objects of the present invention will become apparent from the following detailed description and the appended claims with reference to the accompanying drawings.

According to the first aspect of the invention, there is provided a control method for an image forming system having an image forming apparatus which forms an image onto a sheet and a sheet processing apparatus which is connected to the image forming apparatus and executes a process to the sheet, comprising: a detecting step of detecting an abnormality in communication between the image forming apparatus and the sheet processing apparatus; an avoiding step of executing an avoiding process for the abnormality when the communication abnormality is detected in the detecting step; a preprocessing step of executing a preprocess for a power shutdown in accordance with an operation of a power switch to shut down a power source of the image forming system; and a control step of ignoring the communication abnormality even if the communication abnormality is detected in the detecting step during the preprocessing step and not executing the avoiding step.

Further features of the present invention will become apparent from the following description of exemplary embodiments with reference to the attached drawings.

Further features of the present invention will become apparent from the following description of exemplary embodiments with reference to the attached drawings.

DESCRIPTION OF THE EMBODIMENTS

Embodiments of an image forming system, an image forming apparatus, and an operation control method of the invention will be described hereinbelow with reference to the drawings.

First Embodiment

Figure 1:
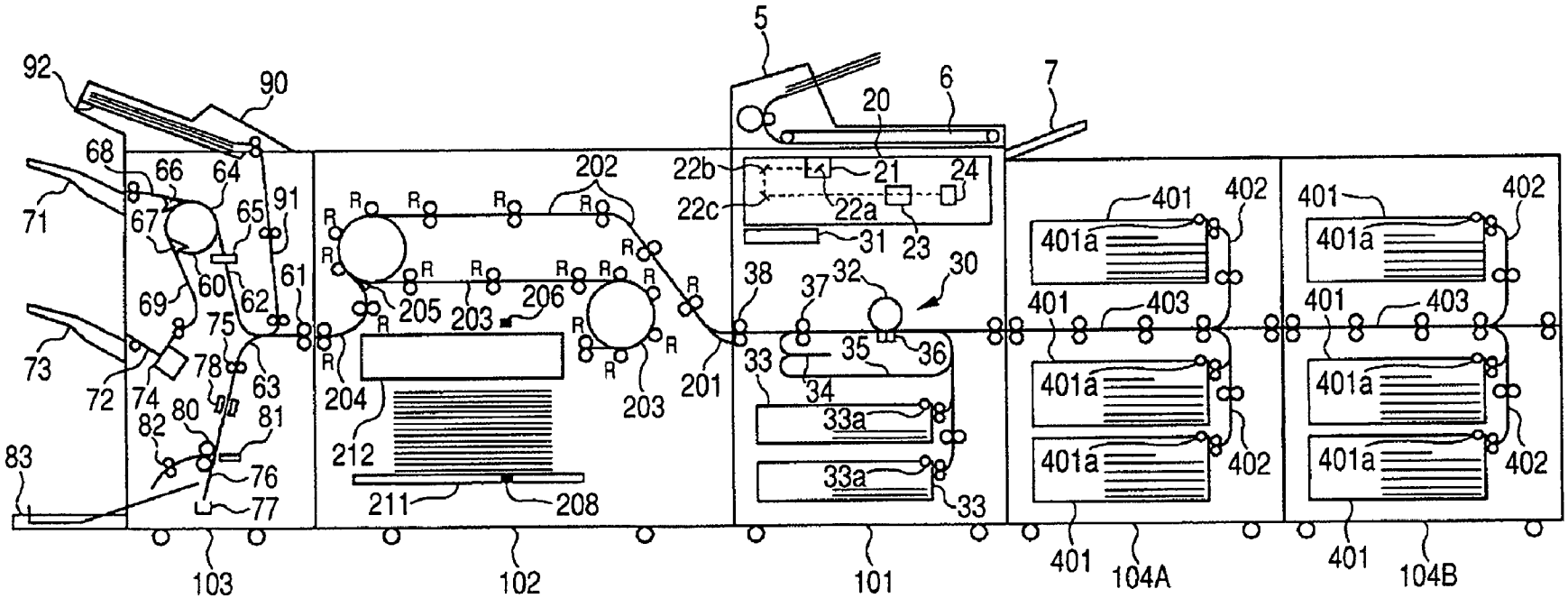
FIG. 1 is a vertical sectional view showing an internal construction of an image forming system according to the first embodiment.

FIG. 1 is a vertical sectional view showing an internal construction of the image forming system according to the first embodiment. The image forming system is constructed by an image forming apparatus 101, a stacker 102, a finisher 103, a sheet feeding apparatus 104A, and a sheet feeding apparatus 104B. Constructions and the operations of those apparatuses are shown here.

(Image Forming Apparatus)

The image forming apparatus 101 has: an image reader 20 for reading an image of an original; and a printer 30 as an image forming portion. An automatic document feeder (ADF) 5 is provided for the image reader 20. The ADF 5 is constructed in such a manner that sheets of document (original sheets) set on a document tray in a face-up state are sequentially fed one by one to the left from the first page, and each of the fed original sheets is conveyed on a platen glass 6 through a curved path from the left side to the right side through a flow-reading position and, thereafter, discharged toward an external discharge tray 7.

When the original sheet which is conveyed passes through the flow-reading position on the platen glass 6 from the left to the right, the image of the original sheet (also referred to as an original image hereinbelow) is read by a scanner unit 21 held at the flow-reading position. Such a reading method is a method which is generally called an original flow reading.

Specifically speaking, when the original passes through the flow-reading position, a reading surface of the original is illuminated by light of a lamp (not shown) of the scanner unit 21. Reflection light from the original is guided to a lens 23 through mirrors 22*a*, 22*b*, and 22*c*. The light which has passed through the lens 23 is formed as an image onto an image pickup surface of an image sensor 24.

The optically-read image is converted into image data by the image sensor 24 and outputted. The image data outputted from the image sensor 24 is subjected to a predetermined process in an image signal controller and, thereafter, inputted as a video signal to an exposure controller 31 of a printer 30.

The exposure controller 31 of the printer 30 modulates a laser beam on the basis of the inputted video signal and outputs it. The modulated laser beam is irradiated onto a photosensitive drum 32 while being scanned by a polygon mirror. An electrostatic latent image according to the scanned laser beam is formed on the photosensitive drum 32. In the case of fixedly reading the original, the exposure controller 31 outputs the laser beam so as to form an image which is not a mirror image.

A plurality of sheet feed cassettes 33 for enclosing sheets adapted to form images are provided in the printer 30 so that they can be pulled out in an apparatus front direction. The sheets can be supplied one by one to the printer 30 from each sheet feed cassette 33 by a separation feeding portion 33*a* provided in correspondence to each sheet feed cassette 33.

In the case of performing a duplex (two-sided) copy to form an image onto a back side of the sheet in which an image has already been formed on one side, the following paths are provided: a reversing path 34 for reversing the sheet in which an image has already been formed on one side; and a duplex conveying path 35 for supplying the reversed sheet to the printer 30 again.

The electrostatic latent image on the photosensitive drum 32 is visualized as a developer image by a developer which is supplied from a developing unit (not shown). The sheet is fed from each sheet feed cassette 33 or the duplex conveying path 35 at the timing synchronized with the start of the irradiation of the laser beam. This sheet is transported between the photosensitive drum 32 and a transfer portion 36. The developer image formed on the photosensitive drum 32 is transferred onto the sheet by the transfer portion 36.

The sheet to which the developer image has been transferred is conveyed to a fixing portion 37. The fixing portion 37 fixes the developer image onto the sheet by heating and pressing the sheet. The sheet which has passed through the fixing portion 37 passes through a conveying roller and a discharge roller 38 and is discharged toward the stacker 102 from the printer 30.

In the case of discharging the sheet in the state where the image forming surface faces downward (face-down), the sheet which has passed through the fixing portion 37 is temporarily guided into the reversing path 34 by the switching operation of a flapper (not shown) provided in a branch portion of the reversing path 34. After a rear edge of the sheet passed through the flapper, the sheet is switched back and discharged from the printer 30 by the discharge roller 38. Such a sheet discharge form is called a "reverse discharge". The reverse discharge is performed in the case of sequentially forming images from the first page as in the case where images read by using the ADF 5 are formed, the case where images outputted from the computer are formed, or the like. The order of sheets after the reverse discharge is the correct page order.

Further, if the duplex recording for forming images onto both sides of the sheet has been set, the sheet is guided to the reversing path 34 by the switching operation of the flapper (not shown) provided in the branch portion of the reversing path 34, the sheet is conveyed to the duplex conveying path 35. The sheet guided to the duplex conveying path 35 is fed again between the photosensitive drum 32 and the transfer portion 36 at predetermined timing.

(Stacker)

The stacker 102 executes a process for sequentially fetching the sheets from the image forming apparatus 101 and stacking onto a stack tray 211 or a process for sending the sheets to the finisher 103. The stack tray 211 stacks a number of sheets which have been ejected from the image forming apparatus 101 and sequentially fetched into the apparatus. A sheet restricting member 212 is provided to improve the sheet stacking performance of the stack tray 211. A sheet entrance portion 201 receives the sheets ejected from the image forming apparatus 101. A conveying path 202 conveys the sheets in the stacker. A conveying path 203 for stacking the sheets is used in the case of stacking the sheets ejected from the image forming apparatus 101 onto the stack tray 211 in the stacker 102.

A conveying path 204 for ejection to the downstream apparatus is used in the case of the sheets ejected from the image forming apparatus 101 to the finisher 103. A conveying path change-over flapper 205 switches the conveying path of the sheets to either the sheet stacking conveying path 203 or the conveying path 204 for ejection to the downstream apparatus. In the case of guiding the sheets to the stack tray 211 in the stacker 102, the flapper 205 switches the conveying path so as to select the sheet stacking conveying path 203. On the other hand, in the case of ejecting the sheets to the finisher 103, the flapper 205 switches the conveying path so as to select the conveying path 204 for ejection to the downstream apparatus.

A conveying roller R conveys the sheets along the conveying paths 202, 203, and 204. Sensors 206 and 208 are used to control an ascent and a descent of the stack tray 211.

(Finisher)

The finisher 103 sequentially fetches the sheets from the stacker 102 and executes various kinds of post-processes to the fetched sheets. There are the following post-processes: a process for aligning the plurality of fetched sheets and binding them into one bundle; a stapling process for stapling a rear edge of the bundle of sheets by using a stapler; a. punching process for forming holes in positions near the rear edge of each of the fetched sheets; a sorting process; a non-sorting process; a booklet process; and the like.

The finisher 103 has an entrance roller pair 61 for guiding the sheets ejected from the stacker 102 to the inside. The downstream of the entrance roller pair 61 is branched to a processing tray path 62 and a booklet path 63 of the sheets. At this branch point, a change-over flapper (not shown) to guide the sheets to either the processing tray path 62 or the booklet path 63 is provided. The sheet guided to the processing tray path 62 is sent to a buffer roller 64 through a conveying roller pair (not shown). A punch unit 65 is provided on the way of the processing tray path 62. If a punch mode has been set, the holes are formed in the positions near the rear edge of each of the conveyed sheets.

The buffer roller 64 is a roller which can overlay and wind a predetermined number of conveyed sheets around its outer periphery. The sheets wound around the buffer roller 64 are conveyed in the rotating direction of the buffer roller 64.

Change-over flappers 66 and 67 are arranged near an outer peripheral conveying path of the buffer roller 64. The change-over flapper 66 on the upstream side is a flapper for peeling off the sheets wound around the buffer roller 64 therefrom and guiding them to a non-sorting path 68 or a sorting path 69. The change-over flapper 67 on the downstream side is a flapper for peeling off the sheets wound around the buffer roller 64 therefrom and guiding them to the sorting path 69 or a buffer path 60 in the state where the sheets wound around the buffer roller 64 have been wound.

The sheets guided to the non-sorting path 68 by the change-over flapper 66 are ejected onto a sample tray 71 through a discharge roller pair (not shown). A discharge sensor (not shown) is provided on the way of the non-sorting path 68. The sheets guided to the sorting path 69 by the change-over flapper 66 are stacked onto a processing tray 72 through a conveying roller (not shown). The sheets stacked as a bundle on the processing tray 72 are subjected to the aligning process, stapling process, or the like as necessary and, thereafter, ejected onto a stacking tray 73 by a discharge roller (not shown). A stapler 74 is used for the stapling process to staple the sheets stacked as a bundle on the processing tray 72. The stacking tray 73 is constructed so as to be movable in the vertical direction and is moved in accordance with a stacking amount of the bundle of sheets.

The sheets from the booklet path 63 are enclosed in an enclosing guide 76 by a conveying roller pair 75 and are, further, conveyed until front edges of the sheets are come into contact with a sheet positioning member 77. The sheet positioning member 77 is movable in the vertical direction. A pair of right and left staplers 78 are provided at halfway positions of the enclosing guide 76 and constructed so as to staple the center portion of the bundle of sheets.

A folding roller pair 80 is provided in a downstream position of the staplers 78. A protruding member 81 is provided at a position which faces the folding roller pair 80. By projecting the protruding member 81 toward the bundle of sheets enclosed in the enclosing guide 76, the bundle of sheets are pushed out between the pair of folding rollers 80. After the bundle of sheets were folded by the folding roller pair 80, they are ejected to a saddle discharge tray 83 through a folded sheet discharge roller 82.

(Sheet Feeding Apparatus)

The sheet feeding apparatuses 104A and 104B are optional sheet feeding apparatuses which are connected to the upstream side of the image forming apparatus 101. In a manner similar to the image forming apparatus 101, a plurality of sheet feed cassettes 401 are provided for the sheet feeding apparatuses 104A and 104B so that they can be freely pulled out in the apparatus front direction. A separation feeding portion 401*a* provided in correspondence to each of the sheet feed cassettes 401 supplies the sheets one by one to the image forming apparatus 101 from each sheet feed cassette 401. The sheets are conveyed to the downstream apparatus through conveying paths 402 and 403.

Figure 2:
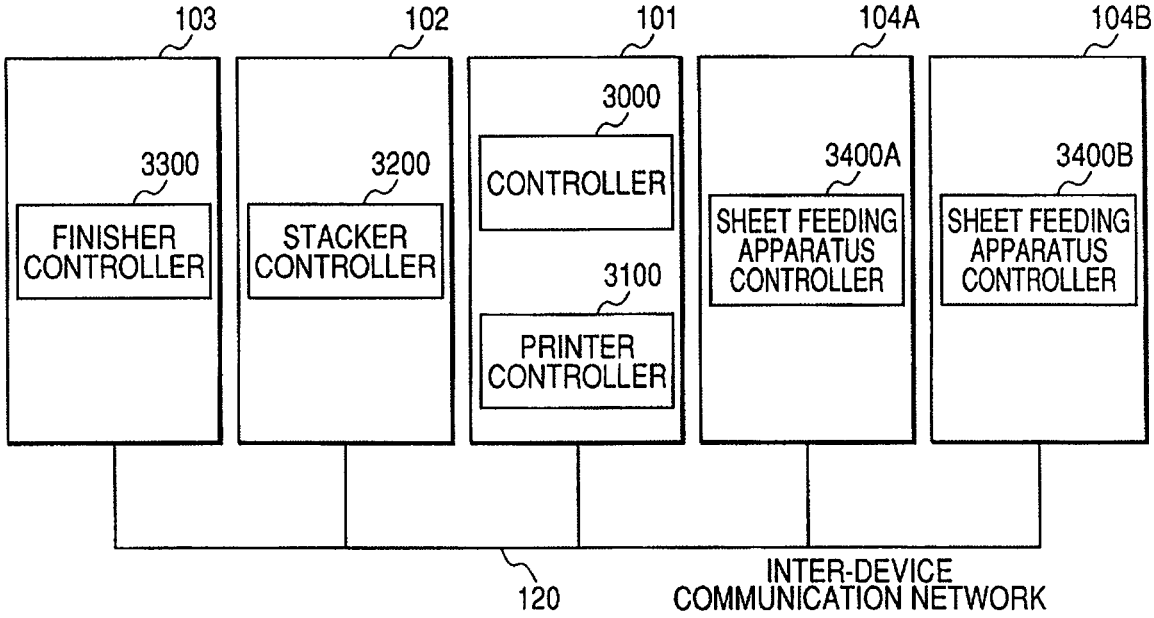
FIG. 2 is a diagram showing a communication network 120 for connecting an image forming apparatus 101, a stacker 102, a finisher 103, a sheet feeding apparatus 104A, and a sheet feeding apparatus 104B.

FIG. 2 is a diagram showing a communication network 120 for connecting the image forming apparatus 101, stacker 102, finisher 103, sheet feeding apparatus 104A, and sheet feeding apparatus 104B. A controller 3000 to manage jobs and a printer controller 3100 to control the image forming operation are provided for the image forming apparatus 101. A stacker controller 3200 for conveying the sheets is provided for the stacker 102. A finisher controller 3300 for executing the sheet process is provided for the finisher 103. Sheet feeding apparatus controllers 3400A and 3400B for feeding the sheets are provided for the sheet feeding apparatuses 104A and 104B, respectively. The image forming apparatus 101, stacker 102, finisher 103, sheet feeding apparatus 104A, and sheet feeding apparatus 104B transmit and receive sheet information and timing information which are necessary for the sheet process through the communication network 120.

FIG. 2 is illustrated for convenience of explanation as if the sheet-feeding/discharge apparatuses (stacker 102, finisher 103, sheet feeding apparatus 104A, and sheet feeding apparatus 104B) were connected to the image forming apparatus 101 by communication lines in a one-to-one correspondence relational manner. However, naturally, all of the sheet-feeding/discharge apparatuses (sheet processing apparatuses) can be also network-connected by one communication line.

Figure 3:
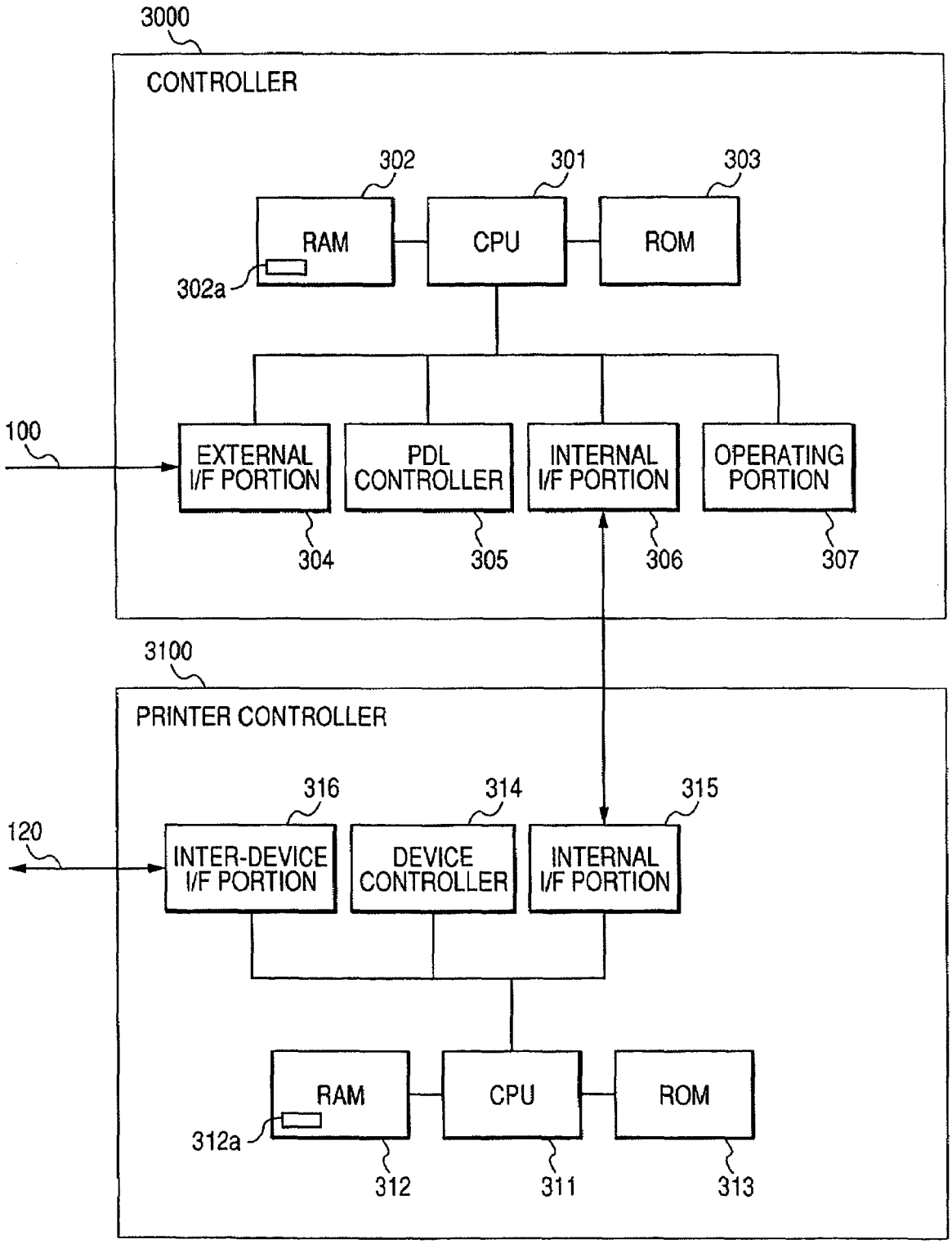
FIG. 3 is a block diagram showing internal constructions of a controller 3000 and a printer controller 3100.

FIG. 3 is a block diagram showing internal constructions of the controller 3000 and the printer controller 3100. In the controller 3000, a CPU 301 is connected to each of a ROM 303 and a RAM 302 through an address bus and a data bus. A control program which is executed by the CPU 301 has been written in the ROM 303. Data which is processed by the CPU 301 is stored into the RAM 302. A job management area 302*a* to store information of an image forming job (hereinafter, simply referred to as a job) has been allocated to the RAM 302.

The following portions are also connected to the CPU 301: an external I/F portion 304 to communicate with the outside; a PDL controller 305 to execute modification, storage, and an image process of the received data; an internal I/F portion 306 to communicate with the printer controller 3100; and an operating portion 307. The CPU 301 controls a display portion and a key input portion provided for the operating portion 307. When the user instructs the CPU 301 to switch display contents through the key input portion, the CPU 301 allows the display portion of the operating portion 307 to display an operation status of the apparatus, an operating mode set by the key input, and the like.

In the printer controller 3100, a CPU 311 is connected to each of a ROM 313 and a RAM 312 through an address bus and a data bus. The CPU 311 makes fundamental control of the image forming operation. A control program which is executed by the CPU 311 has been written in the ROM 313. Data which is processed by the CPU 311 is stored into the RAM 312. An error memory area 312*a* to store information showing an abnormality in the communication of each of the sheet-feeding/discharge apparatuses has been allocated to the RAM 312.

A device controller 314, an internal I/F portion 315, and an inter-device I/F portion 316 are connected to the CPU 311. The device controller 314 includes an input/output port to control each of the component parts of the printer portion, and the like. The internal I/F portion 315 communicates with the controller 3000 and transmits and receives image signals and timing signals. The inter-device I/F portion 316 transmits and receives sheet information and timing information to/from other apparatuses.

In accordance with the control program, the CPU 311 receives the image signals through the controller 3000 and the internal I/F portion 315, controls the device controller 314, and executes the image forming operation. The CPU 311 also transmits and receives the sheet information and the timing information to/from other apparatuses through the inter-device I/F portion 316 and executes the sheet conveying operation.

The CPU 311 in the printer controller 3100 and the CPU 301 in the controller 3000 can mutually transmit and receive information through the internal I/F portions 306 and 315 and can execute processes shown in a flowchart of FIG. 8, which will be explained hereinafter, and the like in cooperation with each other.

Figure 4:
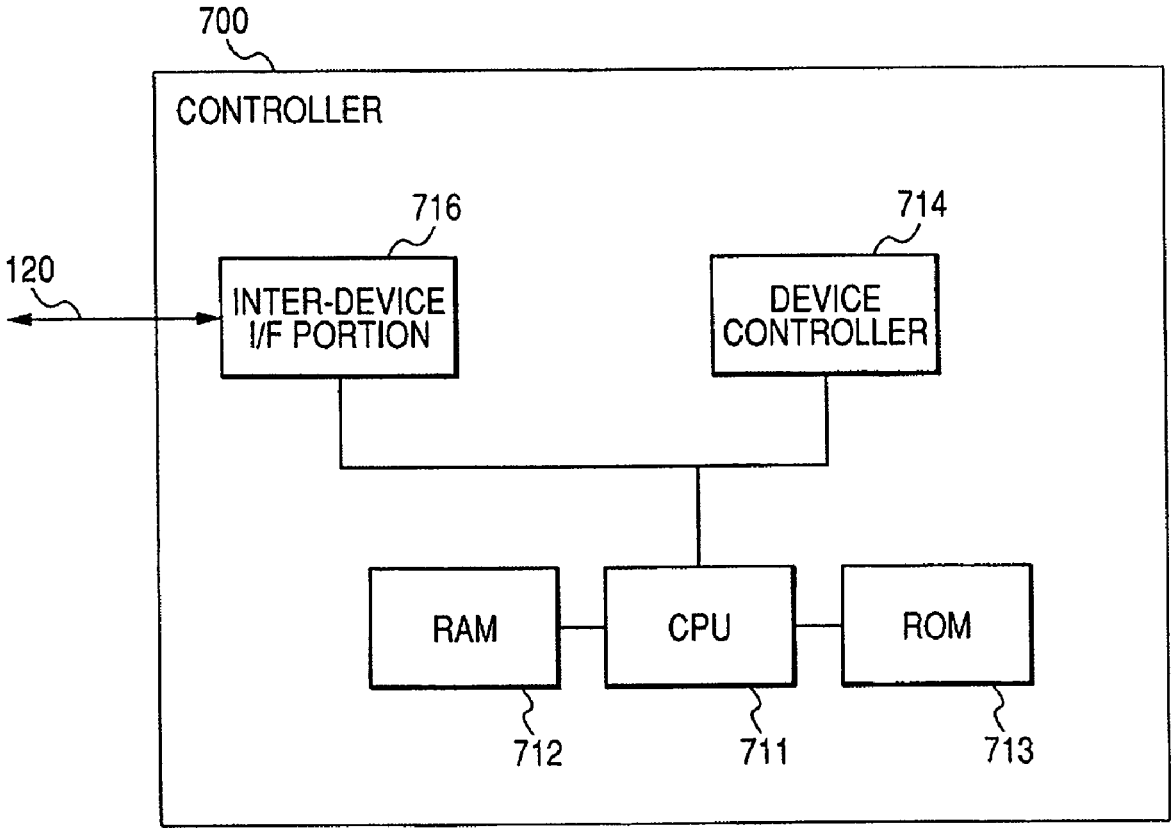
FIG. 4 is a block diagram showing a construction of a controller 700 of each sheet-feeding/discharge apparatus connected to the image forming apparatus 101.

FIG. 4 is a block diagram showing a construction of a controller 700 of each of the sheet-feeding/discharge apparatuses connected to the image forming apparatus 101. As a sheet-feeding/discharge apparatus, each of the stacker controller 3200, the finisher controller 3300, and the sheet feeding apparatus controllers 3400 (3400A and 3400B) has the controller 700 of the same construction. In the controller 700, a CPU 711 is connected to each of a ROM 713 and a RAM 712 through an address bus and a data bus. The CPU 711 controls the sheet conveyance and the sheet process. A control program which is executed by the CPU 711 has been written in the ROM 713. Control data is stored into the RAM 712.

A device controller 714 and an inter-device I/F portion 716 are connected to the CPU 711. The device controller 714 has an input/output port and the like to control each of the component parts of the sheet-feeding/discharge apparatus. The inter-device I/F portion 716 transmits and receives the sheet information and the timing information to/from other sheet-feeding/discharge apparatuses or image forming apparatus. The CPU 711 transmits and receives the sheet information and the timing information to/from other apparatuses through the inter-device I/F portion 716 in accordance with the control program and executes the sheet conveying operation and the sheet process.

Figure 5:
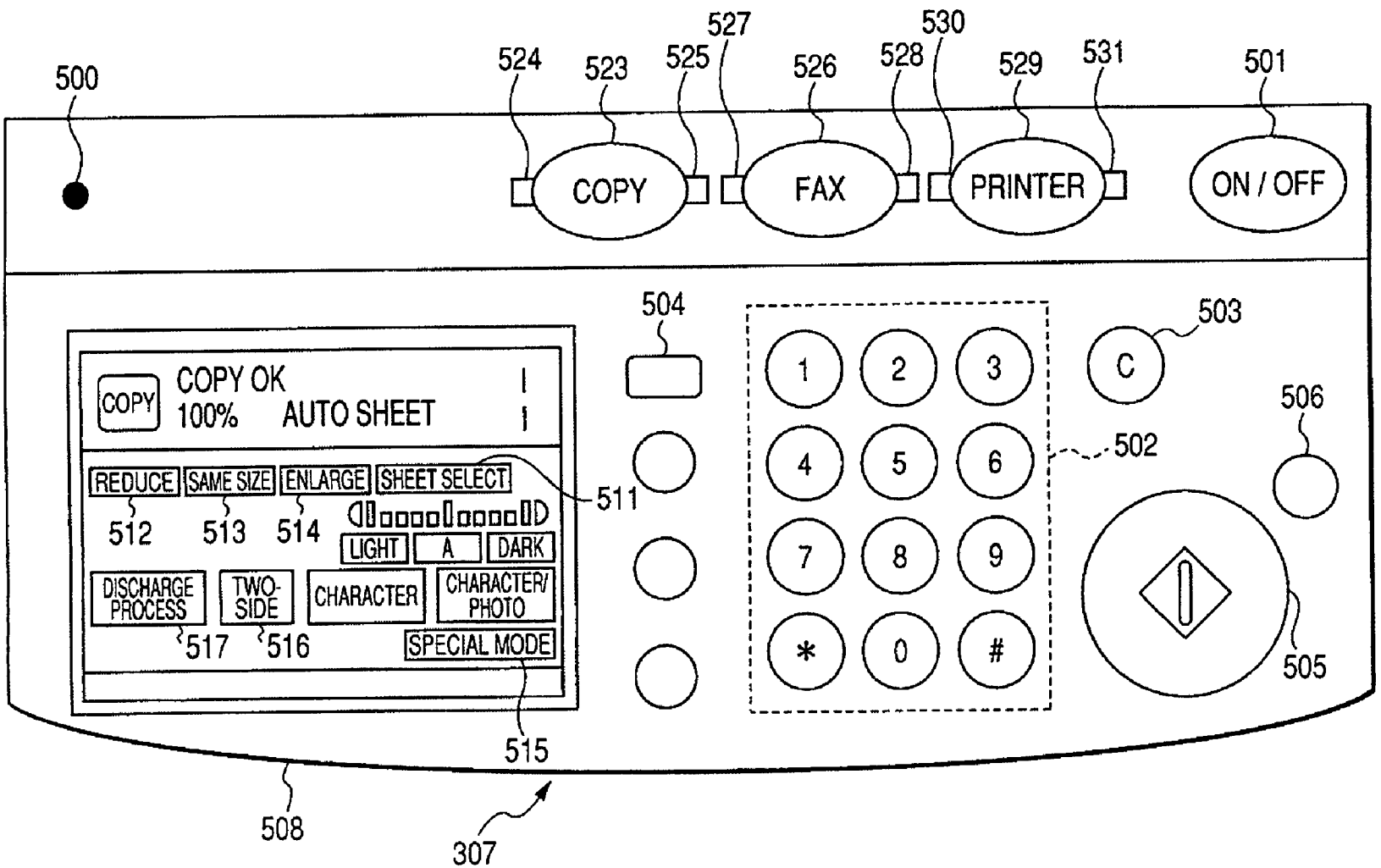
FIG. 5 is a diagram showing an operating portion 307 of the image forming apparatus 101.

FIG. 5 is a diagram showing the operating portion 307 of the image forming apparatus 101. In the diagram, a power lamp 500 is a lamp to indicate that a power source has been turned on. The power lamp 500 is lit on/off in accordance with the switching of ON/OFF of the power source by a power switch 501.

A ten-key 502 is used to input various kinds of numerical values when the number of image forming (copies), the operating mode, or the like is set or used to input a telephone number in a facsimile setting mode. A clear key 503 is used to clear the setting contents inputted through the ten-key 502. A reset key 504 is used to return the set value of the number of image forming copies, the various set operating modes, the selected sheet feed cassette, and the like to default values. By pressing a start key 505, the copying operation can be started.

A stop key 506 is used to stop the image forming operation.

A display panel 508 is constructed by a liquid crystal touch panel. In FIG. 5, a setting display screen of the copy operating mode is displayed on the display panel 508. A plurality of touch keys 511 to 517 are displayed on the setting display screen. Among those touch keys, a sheet select key 511 is a touch key to select the recording paper of a desired size. A reduce key 512, a same size key 513, and an enlarge key 514 are touch keys to set a reduction copy mode, a same size copy mode (direct copy mode), and an enlargement copy mode, respectively. By using the sheet select key 511, not only the sheets in the sheet feed cassette 33 in the image forming apparatus 101 but also the sheets in the sheet feed cassette 401 in the sheet feeding apparatus 104A or the sheet feeding apparatus 104B can be selected.

A special mode key 515 is a touch key to display a display screen for setting various copy modes. A two-sided key (duplex operation setting key) 516 is a touch key to set various kinds of modes regarding the duplex copying operation.

A discharge process key 517 is a touch key which is used when discharge to the stacker 102 is designated, various operating modes of the finisher 103 are set, a sorting mode of the output sheet using an image memory is set, or the like. Among the touch keys displayed on the display panel 508, with respect to each of the touch keys which cannot be used at the present point of time, its display frame is displayed by a broken line or the whole display portion is displayed by a hatched region. The contents of the set copying operation and the current operation status are displayed in an upper region of the display panel 508. Operation statuses of other function modes are displayed in an lower region of the display panel 508.

A copy function key 523, a fax (facsimile) function key 526, and a printer function key 529 are function keys which are used to set the functions of the copying operation, facsimile operation, and printer operation, respectively. By operating those function keys, the display contents of the display panel 508 are also switched. Buttons of those function keys are constructed by semitransparent key buttons. A display lamp (not shown) such as an LED or the like is provided in each key. Only the display lamp of the operated function key is lit on. Each of LEDs 524, 527, and 530 arranged on the left side of those function keys displays the operation situation of each function.

LEDs 525, 528, and 531 arranged on the right side of the copy function key 523, fax function key 526, and printer function key 529 are lit off when an abnormality has occurred in each function.

The key operations of those function keys 523, 526, and 529 are received in any of the operating situations and the setting display screen displayed on the display panel 508 can be changed. The keys existing in the outside of the display panel 508 such as start key 505, stop key 506, reset key 504, and the like function in correspondence to the function selected from the function keys.

The image forming operation in the case where the abnormality has been detected in the inter-device communication in the image forming system having the foregoing construction will now be described. As mentioned above, the image forming apparatus 101, stacker 102, finisher 103, sheet feeding apparatus 104A, and sheet feeding apparatus 104B are connected through the inter-device communication network 120. The sheet information and the timing information which are necessary for the sheet process are transmitted and received among the apparatuses through the inter-device communication network 120. It is, therefore, necessary to discriminate whether or not the communication has normally been made among the apparatuses.

Figure 6:
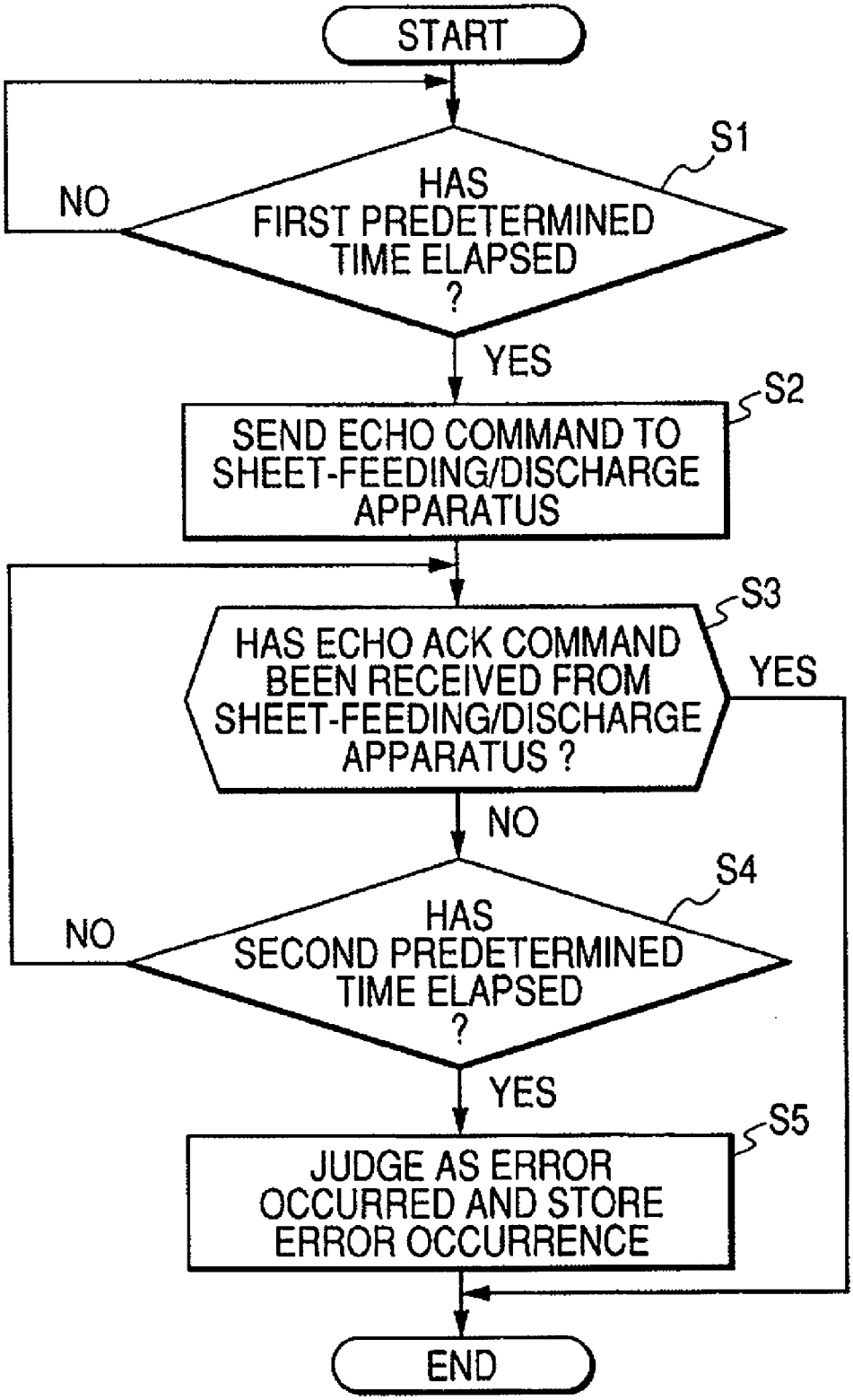
FIG. 6 is a flowchart showing a procedure for an abnormality detecting process in inter-device communication which is made by the image forming apparatus 101.

First, the operation to detect the abnormality in the inter-device communication which is made by the image forming apparatus 101 will be explained. FIG. 6 is a flowchart showing a procedure for an abnormality detecting process in the inter-device communication which is made by the image forming apparatus 101. This processing program has been stored in the ROM 313 in the printer controller 3100 of the image forming apparatus 101 and is likewise executed every predetermined period by the CPU 311 in the printer controller 3100.

First, the CPU 311 discriminates whether or not a first predetermined time has elapsed after the last communication was made (step S1). If the first predetermined time does not elapse, the CPU 311 repeats the process of step S1. If it is confirmed in step S1 that the first predetermined time has elapsed, the CPU 311 sends an Echo command through the inter-device communication network 120 to each of the sheet-feeding/discharge apparatuses connected to the image forming apparatus 101 (step S2).

After that, the CPU 311 discriminates whether or not an EchoAck command has been received from the sheet-feeding/discharge apparatus to which the Echo command was sent (step S3). If the reception of the EchoAck command from the sheet-feeding/discharge apparatus could be confirmed, the CPU 311 finishes the present processing routine. This processing routine is executed again after the predetermined period. When the first predetermined time has elapsed in step S1, similar processes in step S2 and subsequent steps are executed.

If the reception of the EchoAck command from the sheet-feeding/discharge apparatus which sent the Echo command cannot be confirmed in step S3, the CPU 311 discriminates whether or not a second predetermined time has elapsed after the transmission of the Echo command (step S4). If the second predetermined time does not elapse, the processing routine is returned to the process of step S3. The process to confirm the reception of the EchoAck command from each sheet-feeding/discharge apparatus which sent the Echo command is continued.

If the reception of the EchoAck command cannot be confirmed within the second predetermined time, the CPU 311 determines that some abnormality has occurred in the communication with the sheet-feeding/discharge apparatuses connected through the inter-device communication network 120, so that the CPU 311 stores the error occurrence (step S5). After that, the CPU 311 finishes the present processing routine.

Figure 7:
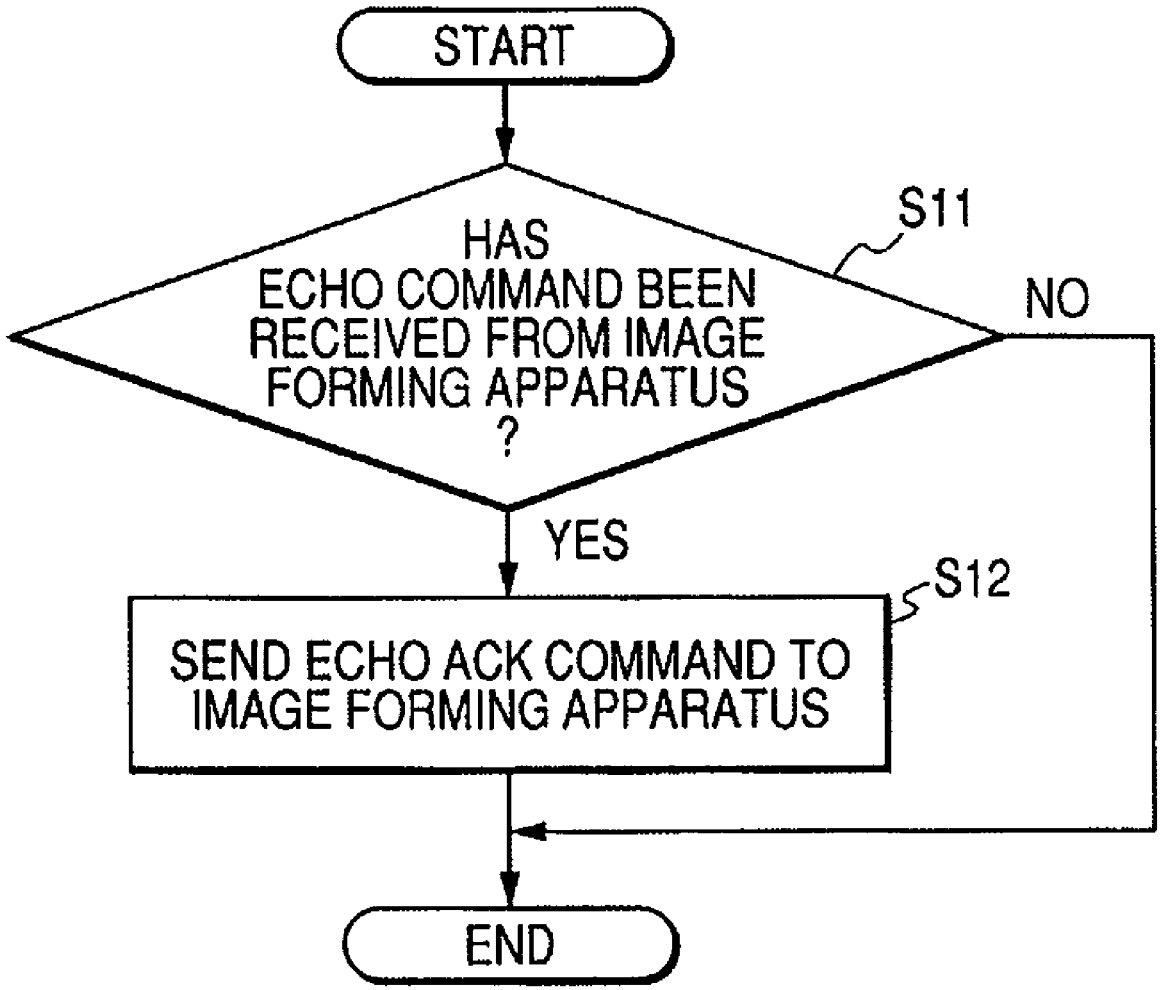
FIG. 7 is a flowchart showing a procedure for a responding process of the abnormality detecting operation in the inter-device communication which is made by the sheet-feeding/discharge apparatuses.

FIG. 7 is a flowchart showing a procedure for a responding process of the abnormality detecting operation in the inter-device communication which is made by the sheet-feeding/discharge apparatuses. This processing program has been stored in the ROM 713 in the controller 700 of each sheet-feeding/discharge apparatus and is executed every predetermined period by the CPU 711. As mentioned above, the sheet-feeding/discharge apparatus is one of the stacker 102, finisher 103, sheet feeding apparatus 104A, and sheet feeding apparatus 104B. The responding process of the abnormality detecting operation in the inter-device communication is executed to the image forming apparatus 101 to which one of the sheet-feeding/discharge apparatuses is connected through the inter-device communication network 120.

First, the CPU 711 discriminates whether or not the Echo command from the image forming apparatus 101 has been received (step S11). If the reception of the Echo command from the image forming apparatus 101 is confirmed, the CPU 711 immediately sends the EchoAck command to the image forming apparatus 101 as a notification showing that the Echo command has been confirmed (step S12). After that, the CPU 711 finishes the present processing routine. If the Echo command is not received, the CPU 711 finishes the present processing routine as it is.

As mentioned above, the image forming apparatus 101 executes in parallel the abnormality detecting operation in the inter-device communication with each sheet-feeding/discharge apparatus. By confirming the reception of the EchoAck command within the second predetermined time, the image forming apparatus 101 discriminates whether or not the communication is normally being made with each sheet-feeding/discharge apparatus through the inter-device communication network 120. That is, the processes shown in the flowcharts of FIGS. 6 and 7 are executed the number of times as many as the number of sheet-feeding/discharge apparatuses connected to the image forming apparatus 101.

Figure 8:
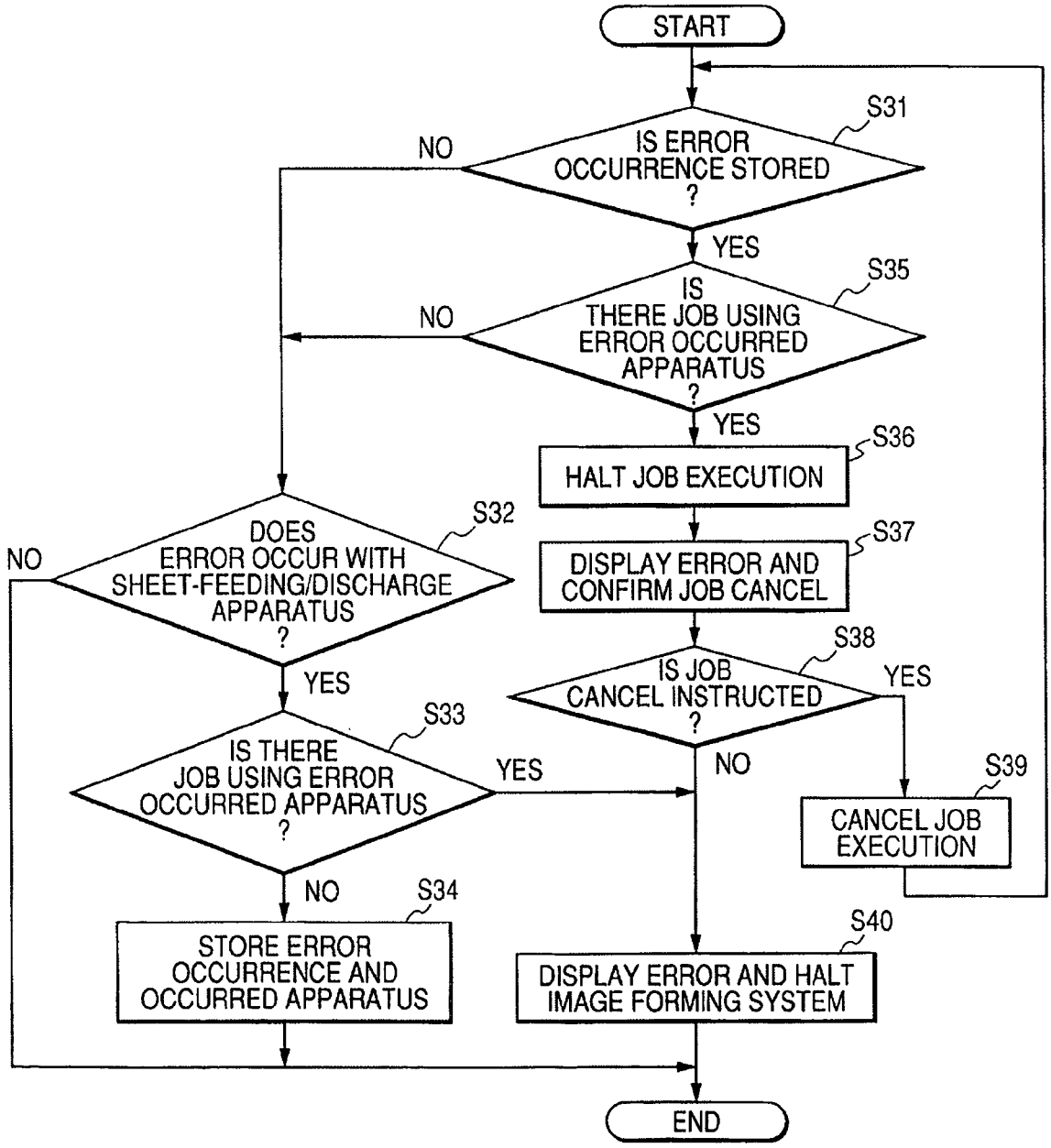
FIG. 8 is a flowchart showing a procedure for an error occurrence process.

FIG. 8 is a flowchart showing a procedure for an error occurrence process. The error occurrence process is executed when the CPU 301 in the controller 3000 in the image forming apparatus 101 executes the control program stored in the ROM 303.

First, to the printer controller 3100, the CPU 301 discriminates whether or not data representing the occurrence of the communication error has been stored (step S31). This confirmation is made when the CPU 311 refers to data stored in the error memory area 312*a* in the RAM 312. If data representing the occurrence of the communication error is not stored, it is determined that the communication among all of the apparatuses in the image forming system is normally being made. To the printer controller 3100, the CPU 301 confirms whether or not there is an occurrence of the communication error due to the abnormality detecting operation (refer to FIGS. 6 and 7) in the inter-device communication (step S32). If there is no occurrence of the communication error in step S32, the present processing routine is finished.

If it is decided in step S32 that the error of the communication with one of the sheet-feeding/discharge apparatuses has occurred, the CPU 301 discriminates whether or not an image forming job using the sheet-feeding/discharge apparatus in which the communication error has occurred (hereinbelow, such an apparatus is referred to as an "error occurred apparatus") is being executed (being inputted) (step S33). As mentioned above, the job information has been managed in the job management area 302*a* in the RAM 302 in the controller 3000.

Figure 11:
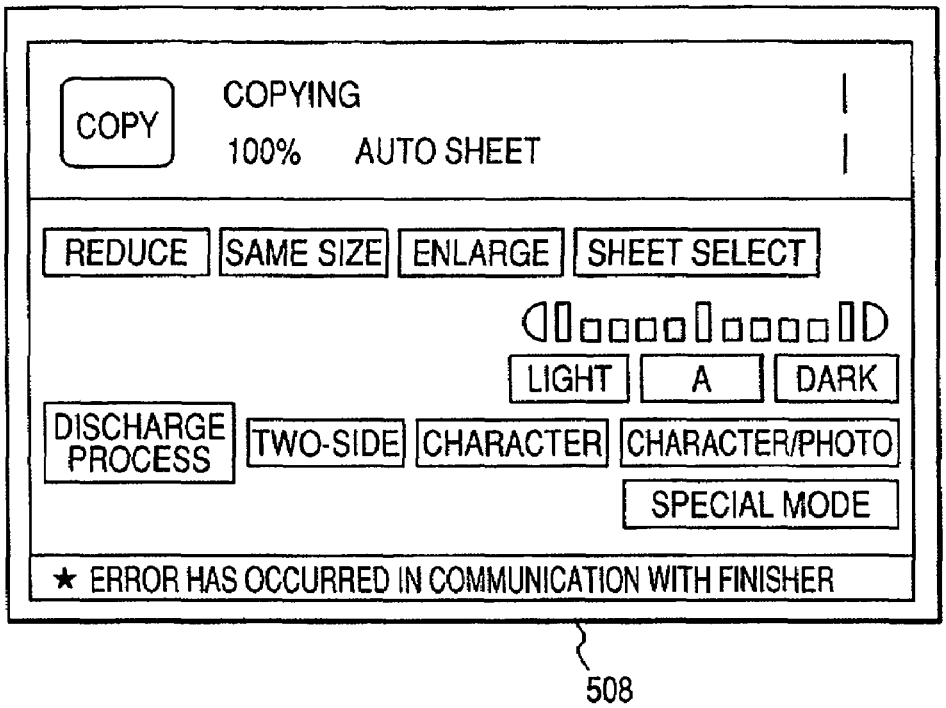
FIG. 11 is a diagram showing a display panel 508 of the operating portion 307 at the time of the occurrence of the communication error in step S34.
Figure 12:
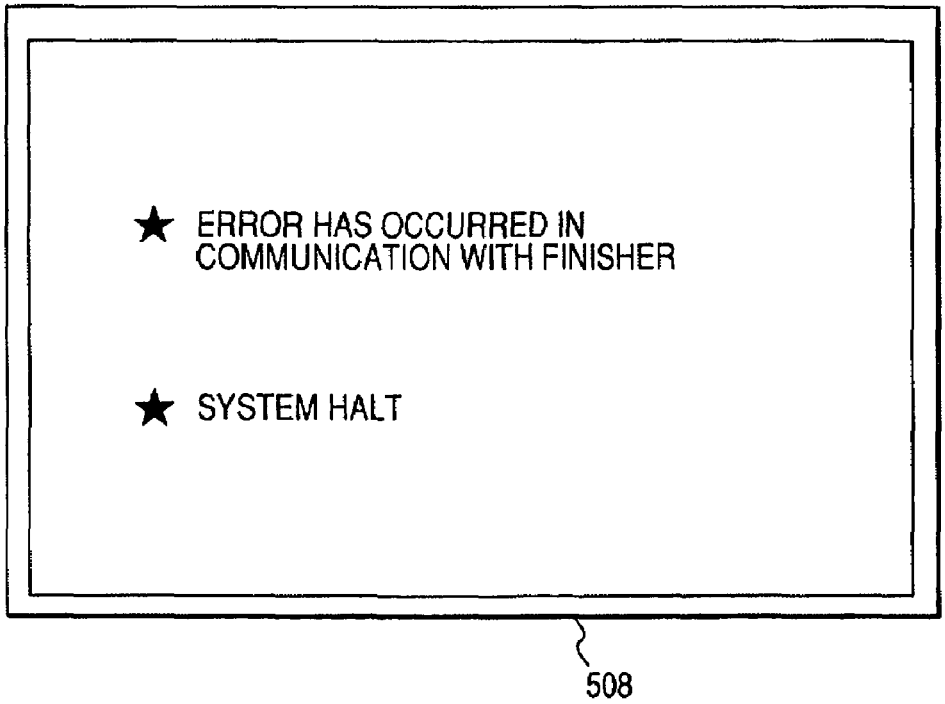
FIG. 12 is a diagram showing the display panel 508 of the operating portion 307 at the time of the occurrence of the communication error in step S40.

When the image forming job using the error occurred apparatus is being executed, the CPU 301 halts the image forming system and displays a message showing the error occurrence to the operating portion 307 (step S40; refer to FIG. 12). After that, the present processing routine is finished. If the image forming job using the error occurred apparatus is not executed in step S33, the CPU 301 displays the communication error occurrence to the operating portion 307 and stores the error occurred apparatus (step S34; refer to FIG. 11). In the process of step S34, only the display of the error occurrence and the storage of the error occurred apparatus are executed and the halt of the image forming system is not performed. A display format of the error occurrence is set to a format which does not to obstruct the display regarding the image forming job which does not use the error occurred apparatus. After that, the present processing routine is finished.

If the occurrence of the communication error has been stored in step S31, the CPU 301 discriminates whether or not the image forming job using the error occurred apparatus in which data representing the communication error occurrence had been stored has been inputted or started (step S35). If it is determined that the image forming job using the error occurred apparatus is not inputted or started, the CPU 301 confirms the presence or absence of the abnormality in the inter-device communication in order to discriminate whether or not the image forming job can be continuously executed for the printer controller 3100 (step S32).

If the image forming job using the error occurred apparatus has been inputted or started in step S35, the CPU 301 decides that the image forming job cannot be normally executed, and halts the execution of the image forming job (step S36). After that, the CPU 301 displays the communication error occurrence to the operating portion 307 and displays a message for allowing the user to confirm the job cancellation (step S37; refer to FIG. 13).

The CPU 301 discriminates whether or not the user has instructed to cancel the job (step S38). If the job cancelling instruction by the user is confirmed, the image forming job using the error occurred apparatus is cancelled (step S39). After that, the processing routine is returned to the process of step S31 and the CPU 301 also makes a similar discrimination with respect to the subsequent image forming jobs. If the job cancellation is not instructed in step S38, since the image forming job cannot be continued, the CPU 301 displays the error occurrence to the operating portion 307 and halts the image forming system.

As mentioned above, even if the error occurred in the communication between the image forming apparatus 101 and one of the sheet-feeding/discharge apparatuses (stacker 102, finisher 103, sheet feeding apparatus 104A, and sheet feeding apparatus 104B) which are connected through the inter-device communication network 120, the invention can cope with such a situation. That is, in the case of the communication error of the sheet-feeding/discharge apparatus which is not concerned with the job, the job can be continued without immediately halting the whole image forming system by the management information of the image forming jobs managed in the controller 3000. This is known as an avoiding process or abnormality countermeasure process. Therefore, usability can be improved.

Since the printing operation is continued without making the image forming system inoperative until a job for the error occurred apparatus is inputted, printing efficiency can be raised. Since the error occurrence situation is displayed even if the image forming system is not halted, the user can discriminate the error occurrence situation.

Figure 9:
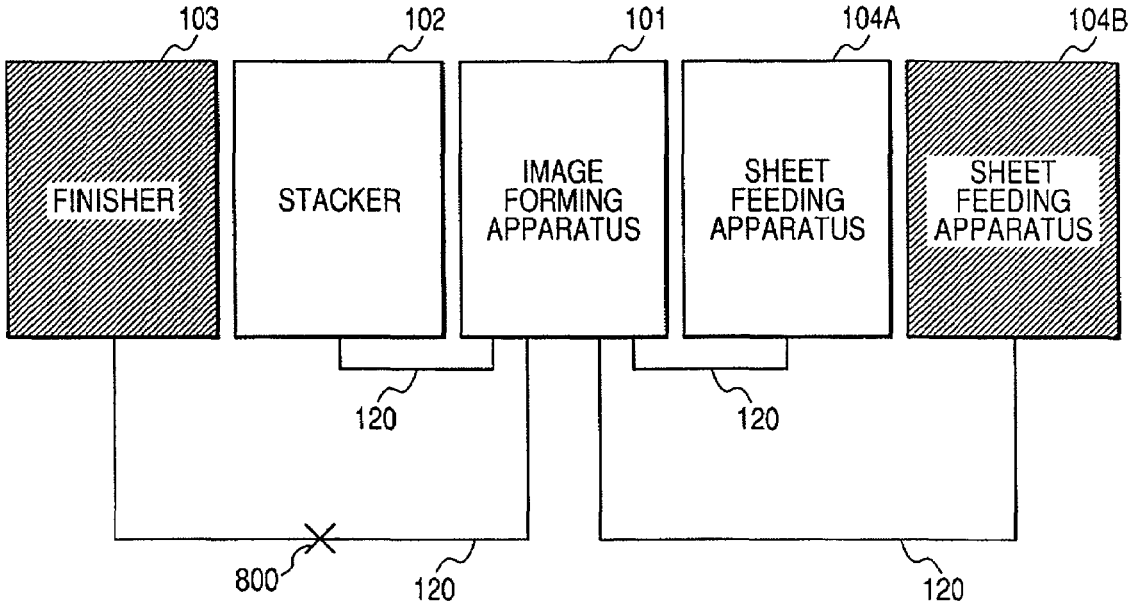
FIG. 9 is a diagram showing an abnormality detecting state of the inter-device communication in the image forming system in the case where an image forming job is continued even if the occurrence of a communication error has been detected.

FIG. 9 is a diagram showing an abnormality detecting state in the inter-device communication in the image forming system. As mentioned above, FIG. 9 is illustrated for convenience of explanation as if the sheet-feeding/discharge apparatuses (stacker 102, finisher 103, sheet feeding apparatus 104A, and sheet feeding apparatus 104B) were connected to the image forming apparatus 101 by communication lines in a one-to-one correspondence relational manner. However, naturally, all of the sheet-feeding/discharge apparatuses can be network-connected by one communication line.

In the diagram, reference numeral 800 denotes a state where the communication error has occurred in the inter-device communication network. The apparatuses shown by hatched regions among the sheet-feeding/discharge apparatuses indicate the apparatuses which are not used in the inputted image forming job. In FIG. 9, the inter-device communication error has occurred between the image forming apparatus 101 and the finisher 103. The finisher 103 and the sheet feeding apparatus 104B are not used in the inputted image forming job. In the inputted image forming job, the image forming apparatus 101, stacker 102, and sheet feeding apparatus 104A are used and the finisher 103 in which the communication error has occurred is not used.

In this state, when the communication error has occurred, only the display of the error occurrence and the storage of the error occurred apparatus are executed without immediately halting the image forming system, and the image forming job can be continued.

Figure 10:
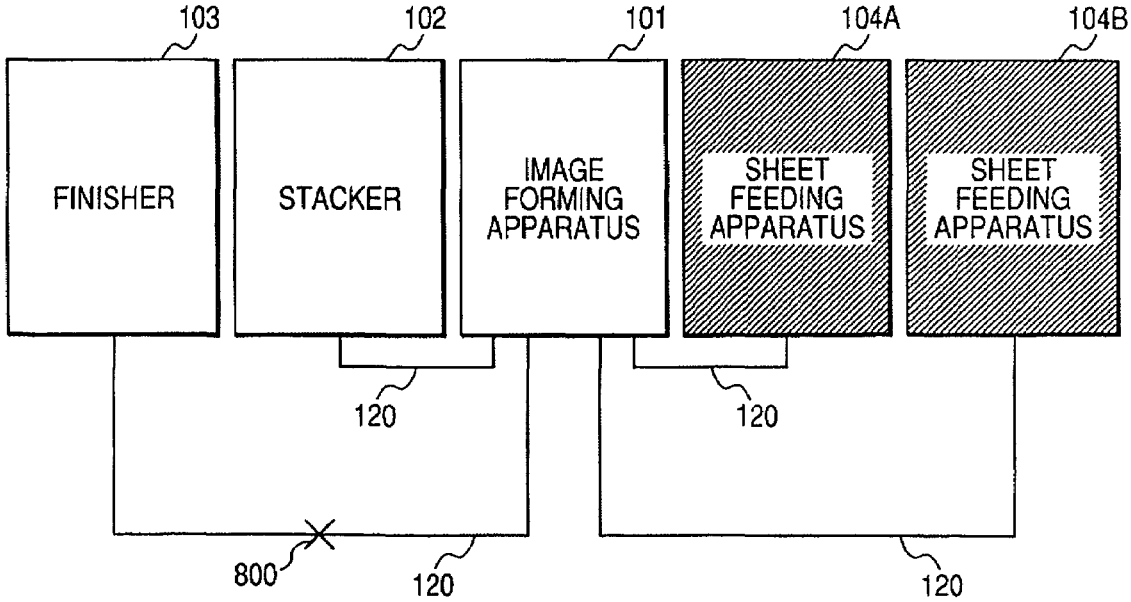
FIG. 10 is a diagram showing an abnormality detecting state of the inter-device communication in the image forming system in the case of halting the image forming system by the detection of the occurrence of the communication error.

FIG. 10 is a diagram showing an abnormality detecting state in the inter-device communication in the image forming system. In FIG. 10, the state where the inter-device communication error has occurred between the image forming apparatus 101 and the finisher 103 is shown. The sheet feeding apparatuses 104A and 104B are not used in the inputted image forming job. The image forming apparatus 101, stacker 102, and the finisher 103 are used in the inputted image forming job.

In the case where the information showing that the communication error had occurred between the image forming apparatus 101 and the finisher 103 has been stored in the error memory area 312*a* in the RAM 312, if such an image forming job has been started (inputted) or if the communication error occurrence is detected when the image forming job is being executed, it is determined that the image forming job is not normally completed. Therefore, the operation of the image forming system is halted.

FIG. 11 is a diagram showing the display panel 508 of the operating portion 307 when the communication error has occurred in step S34. A message showing that the copy job is at present being executed, a message showing the occurrence of the error in the communication with the finisher 103, and the like are displayed on the display panel 508. The state shown in FIG. 11 is the state where although the error in the communication with the finisher 103 has occurred, since the finisher 103 is not used in the inputted job, the job is continuously executed without halting the whole image forming system as shown in FIG. 9.

FIG. 12 is a diagram showing the display panel 508 of the operating portion 307 in the case where the communication error has occurred in step S40. The message showing the occurrence of the error in the communication with the finisher 103 and a message showing that the image forming system has been halted are displayed on the display panel 508. The state shown in FIG. 12 is the state where the communication error in the job using the finisher 103 has occurred or the state where the job has been inputted to the finisher 103 just after the occurrence of the communication error. By displaying the error occurrence situation to the display panel 508 as mentioned above, the user can recognize the situation of the image forming system.

Figure 13:
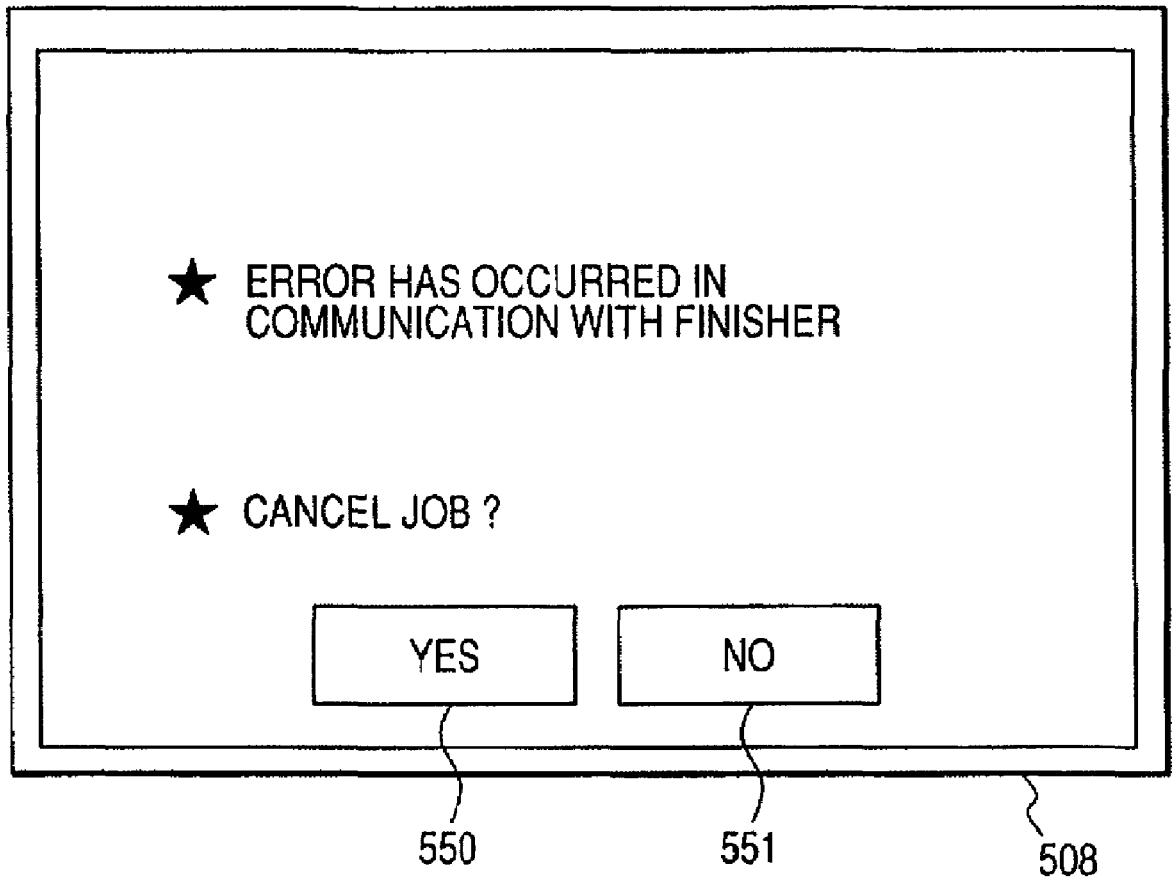
FIG. 13 is a diagram showing the display panel 508 of the operating portion 307 at the time of the occurrence of the communication error in step S37.

FIG. 13 is a diagram showing the display panel 508 of the operating portion 307 at the time of the occurrence of the communication error in step S37. If the image forming job using the sheet-feeding/discharge apparatus in which the communication error has occurred is inputted, a display screen for allowing the user to discriminate whether or not the inputted job is cancelled is displayed. In the diagram, a "YES" key 550 is used to instruct the user to cancel the job. A "NO" key 551 is used to instruct the user not to cancel the job. FIG. 13 shows the state where the error has occurred in the communication with the finisher 103 and the image forming job using the finisher 103 has been inputted. In the case where the error has occurred in the communication with the finisher, the image forming job is temporarily halted. When the "YES" key 550 to instruct the job cancellation is pressed, the inputted job is cancelled and the system waits for the input of the subsequent job without halting the image forming system. On the other hand, if the "NO" key 551 is pressed, since the image forming job using the error occurred apparatus cannot be executed, an error message is displayed and the image forming system is halted (refer to FIG. 12).

According to the image forming system of the first embodiment, as mentioned above, if the error has occurred in the sheet-feeding/discharge apparatus which is not concerned with the job, the job can be continued without halting the whole image forming system and the usability of the user can be improved.

Since the image forming system is not made inoperative until the job using the error occurred apparatus is inputted, even if the error occurred, the printing operation without using the error occurred apparatus can be continued. Since the error occurrence situation is displayed even if the image forming system is not halted, the user can discriminate the error occurrence situation.

Second Embodiment

In an image forming system according to the second embodiment, when a power OFF is instructed by the operation of the power switch 501 of the operating portion 307, power shutdown preprocesses are executed. As power shutdown preprocesses, for example, parts counter information and various kinds of image forming conditions are stored into a non-volatile memory, and a process for halting various kinds of devices in the stable state is executed and, thereafter, the supply of a current/voltage from the power source is shut down, thereby assuring performance of the image forming apparatus.

Since constructions of the image forming apparatus and each sheet-feeding/discharge apparatus in the image forming system according to the second embodiment are similar to those in the foregoing first embodiment, their explanation is omitted. Since the abnormality detecting operation of the inter-device communication is also similar to that in the first embodiment, its explanation is omitted. That is, also in the second embodiment, the processes shown in the flowcharts in FIGS. 6 and 7 mentioned above are executed. The communication abnormality of each sheet-feeding/discharge apparatus is stored in the error memory area 312*a* allocated to the RAM 312 in the printer controller 3100.

Figure 14:
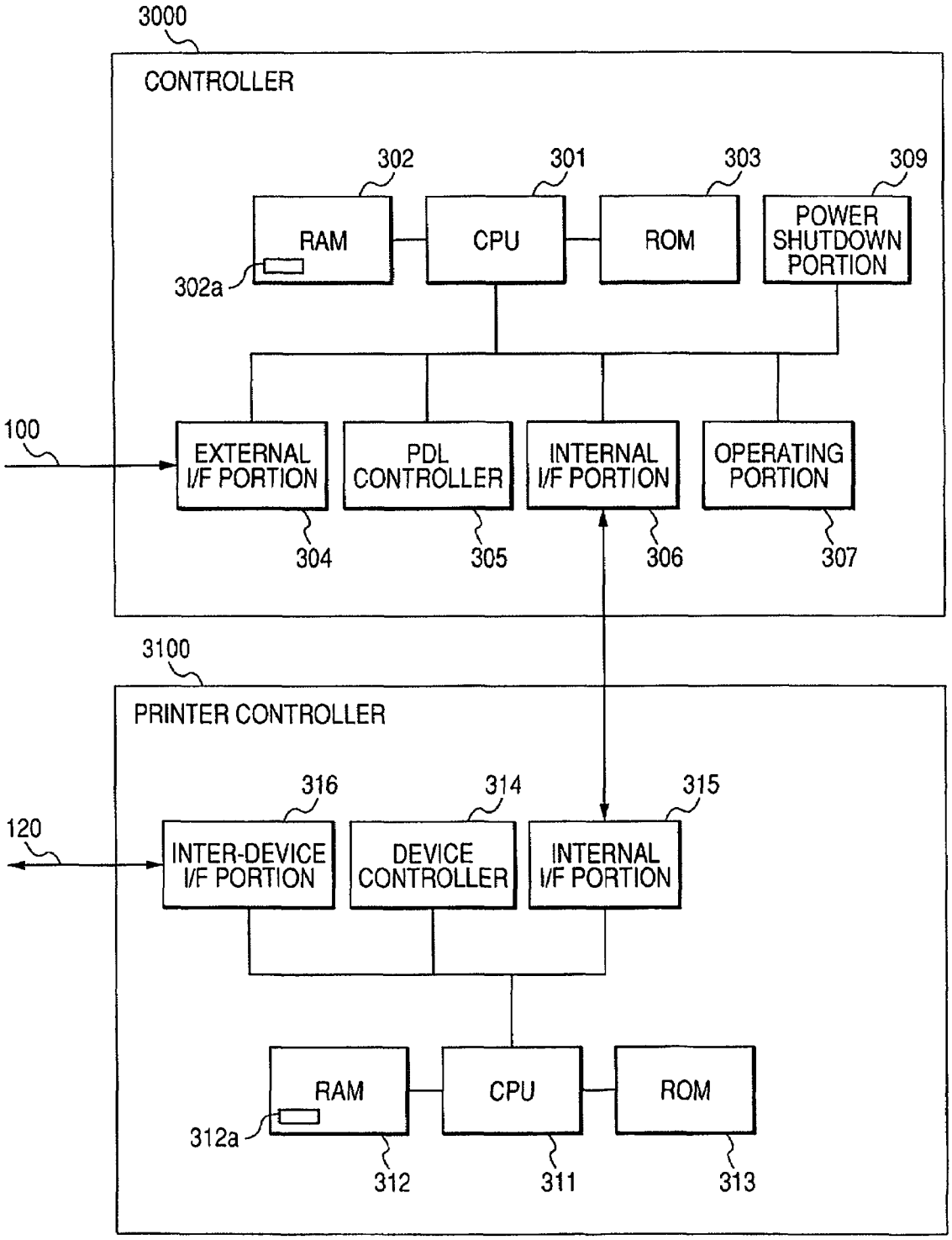
FIG. 14 is a block diagram showing internal constructions of the controller 3000 and the printer controller 3100 in the second embodiment.

FIG. 14 is a block diagram showing internal constructions of the controller 3000 and the printer controller 3100 in the second embodiment. The same component elements as those in the first embodiment are designated by the same reference numerals and their description is omitted. Besides the external I/F portion 304, PDL controller 305, internal I/F portion 306, operating portion 307, a power shutdown portion 309 is connected to the CPU 301 in the controller 3000. In accordance with an instruction from the CPU 301, the power shutdown portion 309 shuts down the voltage/current which is supplied from the power source to the image forming apparatus 101.

Figure 15:
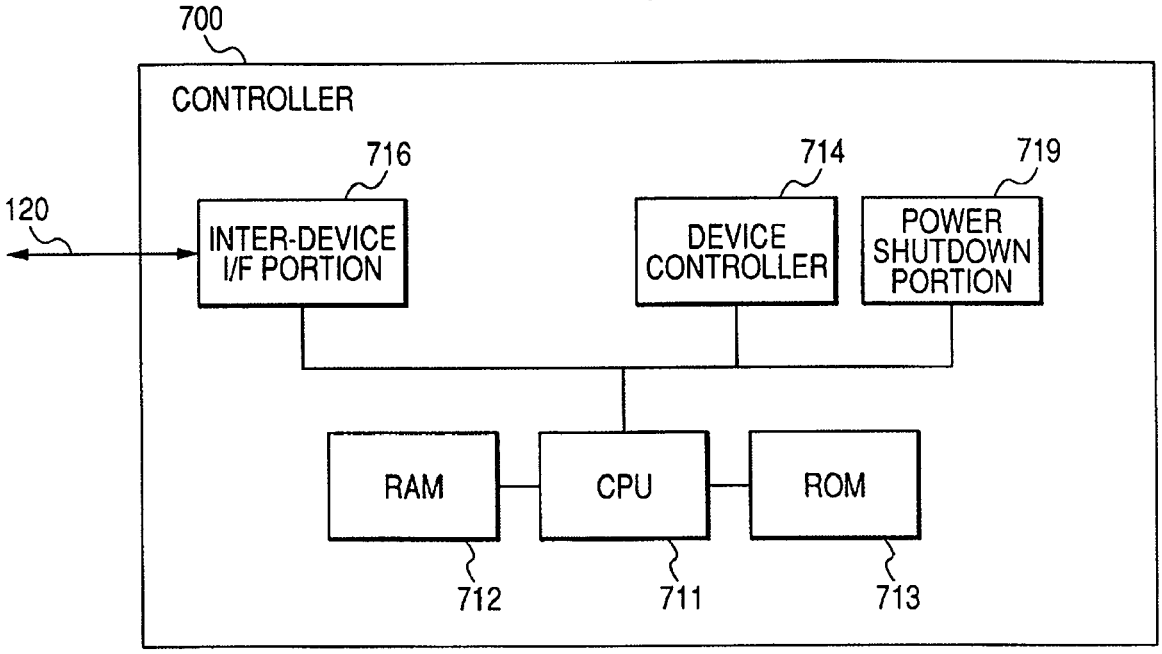
FIG. 15 is a block diagram showing a construction of the controller 700 of each sheet-feeding/discharge apparatus connected to the image forming apparatus 101.

FIG. 15 is a block diagram showing a construction of the controller 700 of each sheet-feeding/discharge apparatus connected to the image forming apparatus 101. The same component elements as those in the first embodiment are designated by the same reference numerals and their description is omitted. Besides the device controller 714 and the inter-device I/F portion 716, a power shutdown portion 719 is connected to the CPU 711 in the controller 700. In accordance with an instruction from the CPU 711, the power shutdown portion 719 shuts down the voltage/current which is supplied from the power source to the sheet-feeding/discharge apparatus. For example, when the instruction to shut down the power source is received from the image forming apparatus 101 through the inter-device communication network 120, the CPU 711 notifies the power shutdown portion 719 of the power shutdown instruction.

Figure 16:
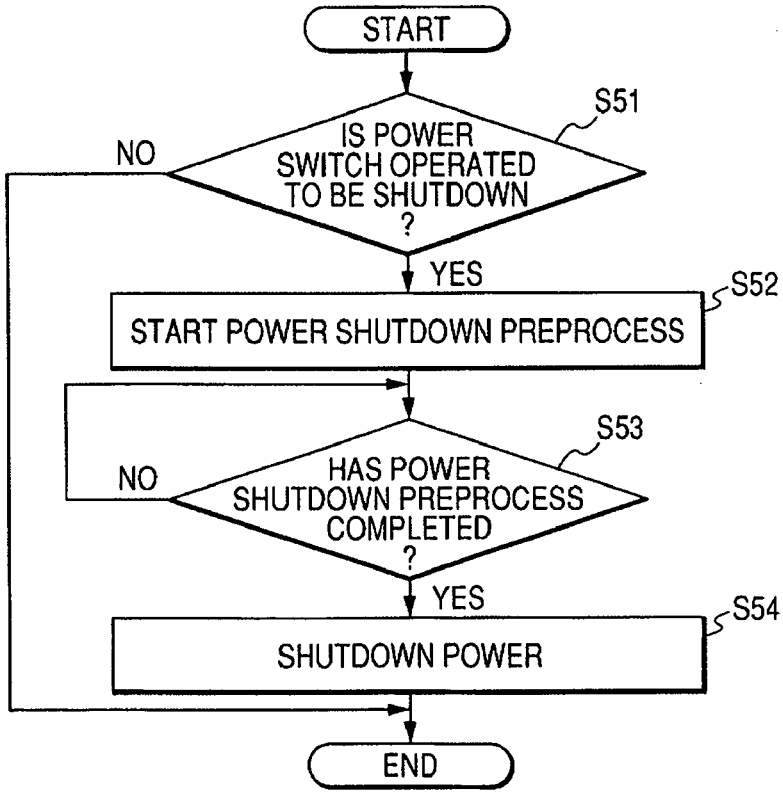
FIG. 16 is a flowchart showing a procedure for a power shutdown control process of the image forming apparatus 101.

FIG. 16 is a flowchart showing a procedure for a power shutdown control process of the image forming apparatus 101. The power shutdown control process is executed when the CPU 301 in the controller 3000 in the image forming apparatus 101 executes the control program stored in the ROM 303.

First, the CPU 301 discriminates whether or not the power switch 501 on the operating portion 307 has been pressed by the user (step S51). If the depression of the power switch 501 is not confirmed, the present processing routine is finished as it is. If the depression of the power switch 501 is confirmed in step S51, the CPU 301 executes the power shutdown preprocesses such as backup of various. kinds of information, stable halt of various kinds of devices, and the like (step S52).

The CPU 301 discriminates whether or not all of the power shutdown preprocesses have been completed (step S53). If NO, the CPU 301 waits for completion of the power shutdown preprocesses. If the completion of all of the power shutdown preprocesses is confirmed, the CPU 301 controls the power shutdown portion 309 so as to halt the supply of the voltage/current from the power source (step S54). The confirmation of the completion of the power shutdown preprocesses in step S53 can be made, for example, by receiving completion responses from the various kinds of devices. It is also possible to confirm it by a method whereby a timer is provided and, when the timer has detected the elapse of a predetermined time from the start of the power shutdown preprocesses, it is decided that they were completed. The power shutdown of each sheet-feeding/discharge apparatus may be performed simultaneously with the power shutdown of the image forming apparatus 101.

Figures 17, 18:
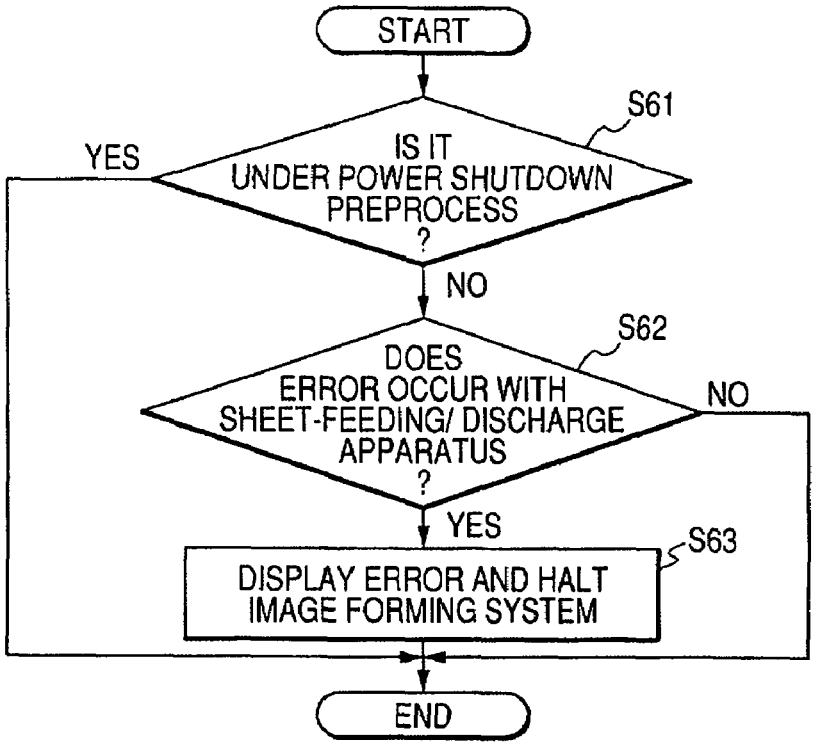
FIG. 17 is a flowchart showing a procedure for an operating process of the image forming system.
FIG. 18 is a diagram showing a display example of a relation among statuses of a plurality of sheet-feeding/discharge apparatuses and jobs.

FIG. 17 is a flowchart showing a procedure for an operating process of the image forming system. This process is executed when the CPU 301 in the controller 3000 in the image forming apparatus 101 executes the control program stored in the ROM 303. This process is executed in parallel with the processing routine of FIG. 16.

As mentioned above, the abnormality detecting process of the inter-device communication between the image forming apparatus 101 and one of the stacker 102, finisher 103, sheet feeding apparatus 104A, and sheet feeding apparatus 104B which are connected through the inter-device communication network 120 is also executed in the second embodiment.

First, the CPU 301 discriminates whether or not the power shutdown preprocesses are being executed (step S61). If NO, the CPU 301 discriminates whether or not the CPU 311 has detected the occurrence of the error in the inter-device communication (step S62). If the communication error has been detected, the CPU 301 displays an error to the operating portion 307 and halts the image forming system (step S63). After that, the present processing routine is finished. If there is no communication error in step S62, the present processing routine is finished as it is. If it is confirmed in step S61 that the power shutdown preprocesses are being executed, the CPU 301 finishes the present processing routine without making the confirmation of the communication error in the abnormality detecting process of the inter-device communication by the CPU 311.

As mentioned above, according to the image forming system of the second embodiment, there is no need to execute the abnormality detecting process of the inter-device communication during the power shutdown preprocesses and the unnecessary discrimination and display of the error occurrence can be omitted. Thus, the usability of the whole image forming system can be improved. After the power shutdown preprocesses, the power supply of the image forming apparatus 101 is certainly shut down and the image forming job is not newly inputted.

In the case where the presence or absence of the occurrence of the communication error is discriminated even during the power shutdown preprocesses in dependence on a construction of the program, it is preferable to ignore the error occurrence even if the occurrence of the communication error is detected.

The invention is not limited to the construction of the foregoing embodiments but can be applied to any construction so long as it can accomplish the functions shown in Claims of the invention and the functions provided by the constructions of the embodiments.

For example, although the communication abnormality which is detected by the inter-device communication has been used as an abnormality of the sheet-feeding/discharge apparatus in the foregoing embodiments, naturally, the invention is not limited to such an abnormality. For example, an abnormality such as defective punching operation, a defective stapling, or the like in the finisher 103 can be mentioned as another abnormality and the invention can be similarly applied to such an abnormality.

In the foregoing first embodiment, in the case where the job using the error occurred apparatus has been inputted, this job can be cancelled at a point of time of the job input (refer to the process of step S38 in FIG. 13). Further, the non-processed jobs stored in the job management area 302*a* can be also cancelled. That is, it is also possible to construct in such a manner that a list of non-processed jobs is displayed onto the display panel 508 of the operating portion 307 and the job using the error occurred apparatus can be cancelled from such a list.

FIG. 18 is a diagram showing a display example of a relation among statuses of the plurality of sheet-feeding/discharge apparatuses and the jobs. The necessary sheet-feeding/discharge apparatuses and their statuses are displayed on the display panel 508 every non-processed job. In the display example of FIG. 18, the state where the error in the communication with the stacker has occurred is shown. Jobs b and c using the stacker cannot be executed in this state. By selecting the jobs b and c and pressing a cancel key 610 on this display screen, the user cancels those jobs. Thus, a period of time during which the printing operation can be continued can be extended without halting the image forming system.

The specific examples of the sheet-feeding/discharge apparatuses are not limited to those in the foregoing embodiments but, naturally, arbitrary kinds of sheet processing apparatuses can be also used.

The object of the invention is also accomplished by a method whereby a storing medium in which program codes of software to realize the functions of the embodiments mentioned above is supplied to a system or an apparatus and a computer (or a CPU, an MPU, or the like) of the system or apparatus reads out and executes the which program codes stored in the storing medium.

In such a case, the program codes themselves read out of the storing medium realize the functions of the embodiments as mentioned above and the storing medium in which the program codes have been stored constructs the invention.

As a storing medium for supplying the program codes, for example, a Floppy (registered trademark) disk, a hard disk, a magnetooptic disk, a CD-ROM, a CD-R, a CD-RW, a DVD-ROM, a DVD-RAM, a DVD-RW, a DVD+RW, a magnetic tape, a non-volatile memory card, a ROM, or the like can be used. The program codes may be downloaded through a network.

The invention incorporates not only the case where the computer executes the read-out program codes, so that the functions of the embodiments are realized but also the case where an OS (Operating System) or the like which is operating in the computer executes a part or all of actual processes on the basis of instructions of the program codes and the functions of the embodiments as mentioned above are realized by those processes.

Further, the invention incorporates the case where the program codes read out of the storing medium are written into a memory provided for a function expanding board inserted in the computer or a function expanding unit connected to the computer, thereafter, a CPU or the like provided for the function expanding board or the function expanding unit executes a part or all of the actual processes on the basis of the instructions of the program codes and the functions of the embodiments are realized by those processes.

While the present invention has been described with reference to exemplary embodiments, it is to be understood that the invention is not limited to the disclosed exemplary embodiments. The scope of the following claims is to be accorded the broadcast interpretation so as to encompass all such modifications and equivalent structures and functions.

This application claims the benefit of Japanese Patent Application Nos. 2005-261120, filed Sep. 8, 2005 and 2006-227703 filed on Aug. 24, 2006 which are hereby incorporated by reference herein in their entirety.

What is claimed is:

1. A control method for an image forming system having an image forming apparatus which forms an image onto a sheet and a sheet processing apparatus which is connected to said image forming apparatus and executes a post-process to said sheet, comprising:

a detecting step of detecting an abnormality in communication between said image forming apparatus and said sheet processing apparatus;

an avoiding step of executing an avoiding process for the abnormality when the communication abnormality is detected in said detecting step;

a preprocessing step of executing a preprocess for a power shutdown in accordance with an operation of a power switch to shut down a power source of said image forming system; and a control step of ignoring said communication abnormality even if the communication abnormality is detected in said detecting step during said preprocessing step and not executing said avoiding step.

2. A control method for an image forming system having an image forming apparatus which forms an image onto a sheet and a sheet processing apparatus which is connected to said image forming apparatus and executes a post-process to said sheet, comprising:

a detecting step of detecting an abnormality in communication between said image forming apparatus and said sheet processing apparatus;

an avoiding step of executing an avoiding process for the abnormality when the communication abnormality is detected in said detecting step;

a preprocessing step of executing a preprocess for a power shutdown in accordance with an operation of a power switch to shut down a power source of said image forming system; and a control step of not executing said detecting step during said preprocessing step.

3. An image forming system having an image forming apparatus which forms an image onto a sheet and a sheet processing apparatus which is connected to said image forming apparatus and executes a post-process to said sheet, comprising:

a communicating device which communicates with said image forming apparatus and said sheet processing apparatus;

an abnormality detecting device which detects an abnormality in communication in said communicating device;

a controller which executes an abnormality countermeasure process for controlling continuation or halt of execution of image creation when the communication abnormality is detected by said abnormality detecting device;

a power switch which is operated to shut down a power source of said image forming system; and a power control device which, when said power switch is operated, shuts down the power source after a preprocess for the power shutdown was executed, wherein even if said communication abnormality is detected during the execution of said preprocess, said controller ignores said communication abnormality and does not execute said abnormality countermeasure process.

4. A system according to claim 3, further comprising a display device which displays information showing that said communication abnormality has been detected, and wherein said controller does not allow said display device to display the communication abnormality even if said communication abnormality has been detected during the execution of said preprocess.

5. An image forming system having an image forming apparatus which forms an image onto a sheet and a sheet processing apparatus which is connected to said image forming apparatus and executes a post-process to said sheet, comprising:

a communicating device which communicates with said image forming apparatus and said sheet processing apparatus;

an abnormality detecting device which detects an abnormality in communication in said communicating device;

a controller which executes an abnormality countermeasure process for controlling continuation or halt of execution of image creation when the communication abnormality is detected by said abnormality detecting device;

a power switch which is operated to shut down a power source of said image forming system; and a power control device which, when said power switch is operated, shuts down the power source after a preprocess for the power shutdown was executed, wherein said abnormality detecting device does not detect the communication abnormality during the execution of said preprocess.

* * * * *